United States Patent [19]

Warner et al.

[11] 4,339,152

[45] Jul. 13, 1982

[54] METHOD AND APPARATUS FOR MIXING GASEOUS OXIDANT AND LIXIVIANT IN AN IN SITU LEACH OPERATION

[75] Inventors: Bert J. Warner, Dallas; Melwyn L. Mathis, Arlington; Warren F. Johnson, Dallas, all of Tex.

[73] Assignee: Mobil Oil Corporation, New York, N.Y.

[21] Appl. No.: 846,874

[22] Filed: Oct. 31, 1977

[51] Int. Cl.[3] ..... E21B 43/28

[52] U.S. Cl. ..... 299/5; 261/64 D; 261/115

[58] Field of Search ..... 299/4, 5; 166/315; 261/74, 64 D, 115, 95, 124

[56] References Cited

U.S. PATENT DOCUMENTS

| | | | |
|---|---|---|---|
| 3,646,579 | 2/1972 | Lewis | 299/4 |
| 3,928,199 | 12/1975 | Kirk et al. | 214/114 R |
| 4,066,297 | 1/1978 | Spence | 299/4 |

*Primary Examiner*—William F. Pate, III

*Attorney, Agent, or Firm*—Charles A. Huggett; James F. Powers, Jr.; John K. AboKhair

[57] ABSTRACT

Method and apparatus for mixing a gaseous oxidant (e.g., oxygen) and a lixiviant (e.g., an aqueous carbonate solution) at a downhole location before the oxygen-saturated lixiviant is injected into a formation to be leached. The invention involves establishing a mixing zone in the well by positioning a mixing means, comprising a housing, in the well at the downhole location. Lixiviant is flowed down the well and through a restrictive opening in the housing to substantially increase the flow velocity of the lixiviant. At the same time, gaseous oxidant is fed to the housing and is trapped therein by the increased velocity of the lixiviant and by packing material in said housing. The lixiviant flows through the trapped oxidant which, in turn, dissolves into the lixiviant to saturate same. Additional packing material is provided in the housing to remove undissolved oxidant from the saturated lixiviant before it is injected into a formation to be leached.

15 Claims, 2 Drawing Figures

METHOD AND APPARATUS FOR MIXING GASEOUS OXIDANT AND LIXIVIANT IN AN IN SITU LEACH OPERATION

BACKGROUND OF THE INVENTION

The present invention relates to the in situ leaching of mineral values and more particularly relates to a method and apparatus for mixing a gaseous oxidant and a lixiviant at a downhole location for use in an in situ leach operation.

In a typical in situ leach operation, wells are completed into a leachable mineral-bearing formation and a lixiviant is flowed between wells to dissolve the mineral values into the lixiviant. The pregnant lixiviant is produced to the surface where it is treated to recover the mineral values from the lixiviant.

Many leachable mineral values as they occur in their natural state in a formation must be oxidized to a higher valence before they become soluble into a lixiviant. For example, uranium is normally present in a formation in the tetravalent state and must be oxidized to the hexavalent state to render it soluble in a suitable lixiviant, e.g., an aqueous carbonate solution. To oxidize uranium to its higher valence, it is customary to contact the uranium in the formation with an oxidant which may be injected directly into the deposit or which may be mixed into the leach solution and injected therewith.

Several oxidants have been proposed for this purpose, including air and oxygen. For example, in U.S. Pat. No. 3,708,206, oxygen is injected into a formation prior to or simultaneously with a lixiviant. In U.S. Pat. No. 3,713,698, air is injected through a production well to oxidize uranium values prior to injecting a lixiviant through an injection well. In both U.S. Pat. Nos. 3,640,579 and 3,860,289, oxygen is supplied through a tube to a downhole location where it is bubbled into a lixiviant before the lixiviant is injected into a formation.

With each of these types of injection schemes, excess quantities of oxygen are required. For example, where oxygen is merely bubbled into the lixiviant downhole before the lixiviant enters the formation, experimentation suggests that a tenfold to fiftyfold excess of oxygen over the saturation requirement is needed, resulting in excessive oxygen costs. Of course, this excess oxygen could be collected, recompressed, and recycled; but the cost of doing this is equally as excessive.

Another approach in mixing oxygen and lixiviant downhole might be to use a mechanical agitator (beater) downhole. However, the high capital investment, along with operational and maintenance costs, makes such an approach impractical. Still another approach is to inject oxygen through fine frits or spargers located downhole to form small bubbles in the lixiviant to effect a good mass transfer of oxygen to the lixiviant. However, based on known in situ leach conditions, precipitates present in the leach operations will likely plug the frits quickly thereby severely restricting the necessary oxygen flow.

Therefore, the method used to mix oxygen or other gaseous oxidants with a lixiviant at a downhole location to saturate the lixiviant before injection into a formation should be simple and rugged in that the apparatus used should (1) not be susceptible to plugging, either by materials carried in the lixiviant or by precipitates resulting from chemical reactions of the oxygen with materials in the lixiviant, (2) be able to be run into and out of the hole as a unit, preferably on the end of the oxygen injection conduit, and (3) be effectively self-controlling, i.e., not requiring complex controls at either the surface or downhole. The method should also be efficient in that (1) substantially no free oxygen gas is allowed to bubble up against the downflowing lixiviant and collect in surface connections and (2) no additional energy sources such as power for motor-driven downhole mixers, etc., are required. Further substantial amounts of free or undissolved oxygen, if permitted to enter the formation with the lixiviant may adversely affect the efficiency of the leach operation. Therefore, some means should be provided to control the amount of free oxygen in the saturated lixiviant before it is injected into the formation.

SUMMARY OF THE INVENTION

The present invention provides a method and apparatus for mixing a gas and a liquid at a downhole location in a well to saturate the liquid with the gas without requiring any substantial amount of excess gas. More specifically, in the present invention, a mixing zone is established in an injection well of an in situ leach operation wherein a lixiviant, e.g., an aqueous carbonate solution, is saturated with a gaseous oxidant, e.g., oxygen, before the lixiviant is injected into the formation to be leached.

In carrying out the present invention, a mixing means is attached to the lower end of a conduit which, in turn, is connected to a source of gaseous oxidant. The mixing means is lowered with the conduit to the downhole location in the well. The mixing means is comprised of a housing having a restrictive opening through its upper end which is filled with a packing material. Similar packing material also fills the lower, open end of the housing. The conduit extends into said housing and has a valve thereon which is responsive to the amount of oxidant within the housing to control the flow of oxidant from the conduit.

Lixiviant is flowed down the annulus formed between the wall of the well and the oxidant conduit to the mixing means where it flows through the restrictive opening into the housing thereby substantially increasing its flow velocity. At the same time, gaseous oxidant is fed down the conduit and exits into the housing in the form of small bubbles which rise in the lixiviant within the housing. The increased velocity through the opening in the housing increases the drag force on the bubbles and the pressure drop across the opening reduces the effective buoyant force at that point. Together, these effects prevent the bubbles from passing through the flooded, packing material in the opening and are trapped to form a large bubble of oxidant just below the opening in the mixing zone in the housing.

The lixiviant now flows through this large oxidant bubble where oxidant from the bubble dissolves into the lixiviant to saturate same. The saturated lixiviant continues on through the housing and out through the packing material at the lower end thereof. This lower packing material allows the flow of lixiviant and dissolved oxidant therethrough but prevents the flow of any substantial amounts of undissolved oxidant. The undissolved oxidant collects on the upper side of the lower packing from which it eventually breaks loose to float up into the large bubble at the upper end of said housing. If excess oxidant begins to build up in the housing, the valve on the conduit responds to restrict oxidant flow into the housing until the volume of oxidant is reduced back within acceptable limits.

BRIEF DESCRIPTION OF THE DRAWINGS

The actual operation and apparent advantages of the invention will be better understood by referring to the drawings in which like numerals identify like parts and in which.

DESCRIPTION OF THE PREFERRED EMBODIMENTS

Figure 1:
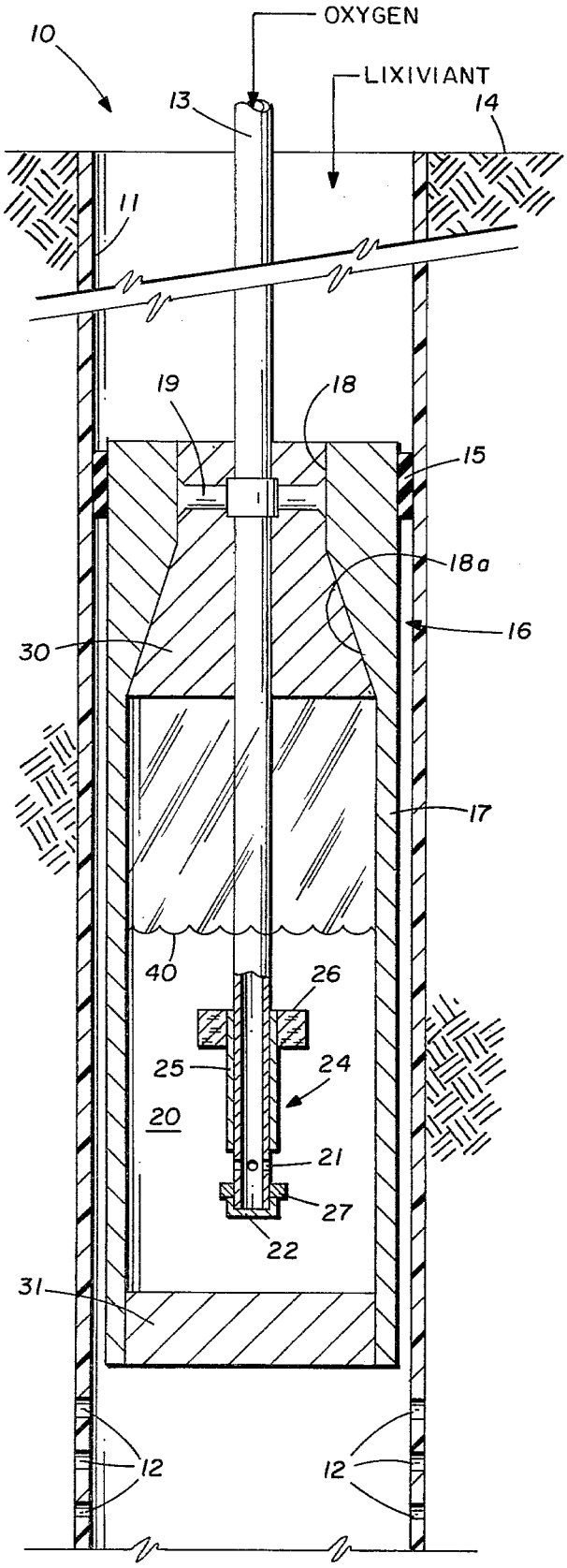
FIG. 1 is an elevational view, partly in section, of the present invention in position in a well.

Referring more particularly to the drawings, FIG. 1 discloses an injection well 10 which is used to inject a liquid lixiviant, e.g., an aqueous carbonate solution in an in situ mineral leach, e.g., uranium. Well 10 is completed in a known manner with a casing 11 of polyvinyl chloride pipe or the like. Perforations 12 are provided through casing 11 adjacent the formation to be leached to allow lixiviant to flow from casing 11 into the formation (not shown).

Conduit 13 which is adapted to be connected to a source of a gaseous oxidant, e.g., oxygen, extends from surface 14 into well 10 to a point just above perforations 12. Mixing means 16 is positioned at the lower end of conduit 13 and is preferably attached thereto so that mixing means 16, as a unit, can easily be carried by conduit 13 into and out of casing 11. Mixing means 16 is comprised of a cylindrical housing 17 having a restrictive opening 18 through its upper end. Opening 18 is referred to as a restrictive opening in that it has a diameter substantially smaller than the diameter of casing 11. Spider 19 or the like centers conduit 13 in opening 18 and serves to attach mixing means 16 to conduit 13. A packer 15 or the like is attached to outer surface of housing 17 and is adapted to provide a seal between housing 17 and casing 11 when mixing means 16 is in an operable position within well 10.

Conduit 13 extends into mixing zone 20, defined by the interior of housing 17, and has openings 21 therein to allow gaseous oxidant to flow from conduit 13 into mixing zone 20. A cap 22 or the like seals the lower end of conduit 13. It should be recognized that in some instances openings 21 could take other forms, e.g., slots, plurality of smaller holes, open lower end of conduit 13, etc., without departing from the present invention.

Slidably mounted on conduit 13 is valve 24 comprised of sleeve 25 having a ring 26 of buoyant material, e.g., cork secured thereto for a purpose discussed below. Valve 24 is adapted to move between an open position (shown in FIG. 1) and a closed position (not shown) when sleeve 25 moves downward against stop 27.

Packing material 30 is provided to fill opening 18 and passage **18*a* through the upper end of housing 17. Packing material 30 may be of any material that prevents the upward flow of free gaseous oxidant but permits downward flow of lixiviant therethrough when mixing means 16 is in an operable condition. Examples of such material are relatively high-density, fibrous materials not wettable by water, e.g., Teflon, polyethylene, polypropylene. Specifically, one such material is a polypropylene mesh knited from flat fibers 0.05 inch in width such as that used in some commercially available scouring pads. Packing material 31, of the same material as packing 30, is positioned in housing 17 below conduit 13 to close the lower end of housing 17** thereof for a purpose discussed below.

In operation, mixing means 16 is attached to the lower end of conduit 13 and is lowered thereby into well 10 to a point just above perforations 12 which lie adjacent a formation (not shown) to be leached. Lixiviant, e.g., an aqueous solution containing carbon dioxide, is flowed down the annulus between conduit 13 and casing 11. Lixiviant flows through restrictive opening 18, floods packing material 30, and continues on into mixing zone 20 within housing 17.

Meanwhile, gaseous oxidant, e.g., oxygen, is simultaneously flowed through conduit 13, out openings 21, and into mixing zone 20. Valve 24 will be open since buoyant material 26 will rise in the lixiviant to move valve 24 to an open position. The oxygen will exit openings 21 in the form of small bubbles which will rise to packing material 30. The increased velocity of the lixiviant through opening 18 increases the drag force on the oxygen bubbles, and the increased pressure drop across opening 18 decreases the effective buoyant force. Together, these effects prevent the oxygen bubbles from passing upward through packing material 30. The small bubbles attach to packing material 30 and are trapped and grow by coalescence with each other until a large bubble (shown as 40 in FIG. 1) is formed which extends below packing material 30.

The lixiviant passing with increased velocity through opening 18 and packing material 30 is jetted through bubble 40 of trapped oxygen. Oxygen from bubble 40 dissolves into the lixiviant which becomes saturated by the oxygen. By regulating the flow rate of the oxygen in relation to the flow rate of the lixiviant, the lixiviant can be properly saturated without the need of excess oxygen being injected thereby substantially improving both the efficiency and the economics of the operation. If an excess of oxygen is ever injected in the present invention and was not controlled, bubble 40 would continue to grow until it reached perforations 12 where it would enter the formation. However, the injection of excess oxygen is controlled in the present invention. If excess oxygen is injected, bubble 40 will only grow until it reaches buoyant material 26 on valve 24. The change in density of the fluids surrounding material 26 will cause sleeve 25 to move down to close openings 21 thereby shutting off or reducing the flow of oxygen into mixing zone 20. As the continued flow of lixiviant dissolves oxygen from bubble 40, the bubble reduces in size thereby increasing the density of the fluids around buoyant material 26 to allow valve 24 to open, readmitting oxygen to mixing zone 20.

It is possible that some free oxygen might be picked up by and become entrained in the downflowing lixiviant and might be carried along with the dissolved oxygen into the formation. There is reason to believe that such free oxygen bubbles might be detrimental to the overall leach operations; so in the present invention, packing material 31 is provided through which the saturated lixiviant from mixing zone 20 must flow before it enters the formation through perforations 12. The free bubbles of oxygen can not flow through packing material 31 and will attach themselves to the packing and grow into larger bubbles which finally break loose to return into bubble 40.

Figure 2:
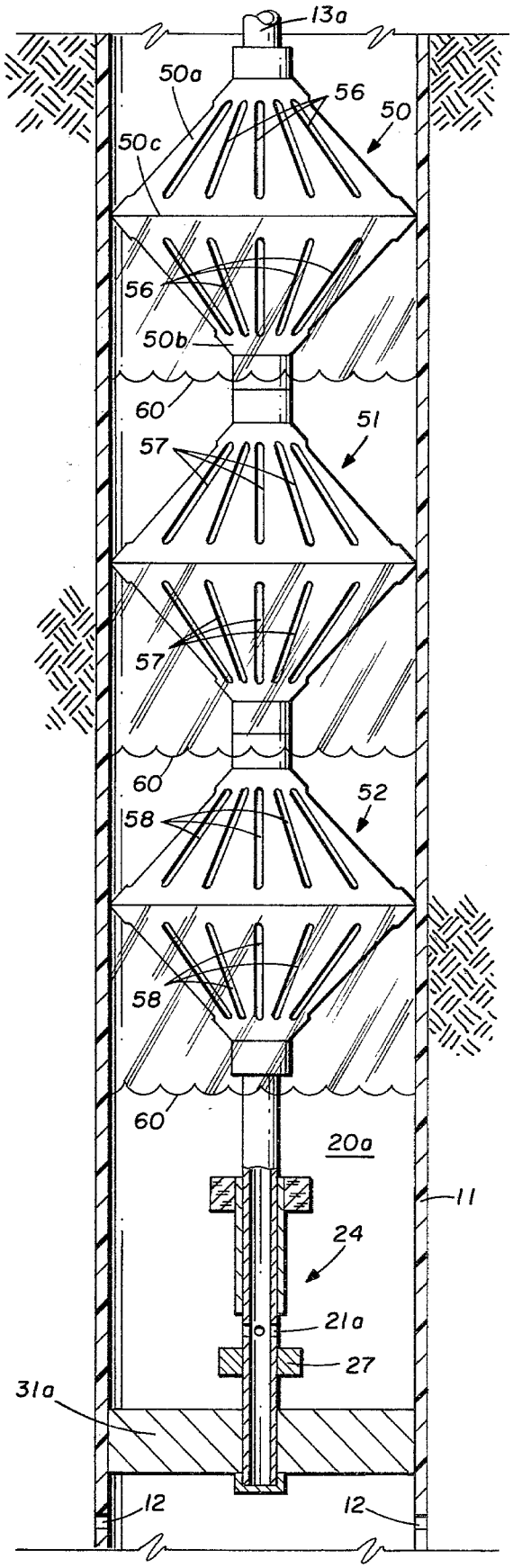
FIG. 2 is an elevational view, partly in section, of a modification of the mixing means of the present invention.

A second modification is shown in FIG. 2 wherein mixing means **16*a* is shown attached to the lower end of conduit 13*a* which has been lowered into casing 11. Mixing means 16*a* is comprised of a plurality of mixer elements 50, 51, 52. Each mixer element is identical and is comprised of two hollow, conical members, e.g., element 50 is comprised of members 50***a*, 50*b*, joined at their bases 50*c*. Each member of each mixer element 50,51,52 has a plurality of restrictive passages, i.e., slots 56,57,58, respectively, which communicate the annulus between conduit 13*a* and casing 11 with the interior of each respective mixer element 50,51,52.

A plurality of openings 21*a* are provided in conduit 13*a* to allow oxygen to enter mixing zone 20*a* which extends adjacent mixing means 50. Valve 24 is slidably mounted on conduit 13*a* and operates in the same manner as previously described. Packing material 31*a* of the same type as previously described in relation to FIG. 1 is mounted on the lower end of conduit 13*a* by means of cap 31*a* or the like.

The operation of the modification shown in FIG. 2 is basically similar to that of FIG. 1 in that a lixiviant is flowed down the annulus between conduit 13*a* and casing 11. Lixiviant will enter mixer element 50 through restrictive passage 56 in member 50*a* and will exit through restrictive passage 56 in member 50*b*. The lixiviant continues on through mixer elements 51 and 52 through restrictive passages 57,58, respectively.

Simultaneously, oxygen is flowed down conduit 13*a* and out opening 21*a* in the form of small bubbles which rise in the lixiviant into contact with mixer element 52. The increased velocity of the lixiviant flowing through the restrictive passages 58 increases the drag of the oxygen bubbles trying to rise through mixer element 52, and the pressure drop across mixer element 52 decreases the effective buoyant force, thereby trapping the oxygen on the underside of mixer element 52. The small bubbles collect and grow into a large bubble 60, through which lixiviant must pass when exiting mixer element 52. Oxygen within bubble 60 dissolves into the lixiviant, thereby saturating the lixiviant with oxygen.

Where the diameter of casing 11 is small, e.g., 4 inches, one mixer element may not provide a sufficient increase in lixiviant flow velocity, pressure drop, and surface contact area to adequately trap and hold all of the oxygen necessary to saturate certain required flow rates of lixiviants. Therefore, additional mixer elements 51,50 are used to trap the oxygen, i.e., bubbles 61,62, respectively, which may get through a lower placed mixer element. Both mixer elements 50,51 function in the same manner as described in relation to mixer element 52. Sufficient mixer elements are used to trap substantially all of the injected oxygen to prevent oxygen from bubbling to the surface.

As stated above, valve 24 functions in the same manner as that in FIG. 1 to respond to the size of bubble 60 to regulate the supply of oxygen to mixing zone 20*a* to prevent excess oxygen from being injected and wasted in the operation. Packing 31*a* also functions in the same manner as packing material 30 in FIG. 1 to remove any free oxygen from the saturated lixiviant before it enters the formation through perforations 12.

What is claimed is:

1. A method of mixing a gaseous oxidant and a lixiviant at a downhole location within a well, said method comprising:

supplying said gaseous oxidant to a mixing zone near the lower end of said injection well;

trapping said gaseous oxidant within said mixing zone;

passing said lixiviant through said trapped gaseous oxidant within said mixing zone to mix and dissolve said gaseous oxidant into said lixiviant; and removing undissolved gaseous oxidant from said lixiviant after said lixiviant has passed through said trapped gaseous oxidant.

2. The method of claim 1 including:

increasing the velocity of said lixiviant as it enters said mixing zone just prior to being passed through said trapped gaseous oxidant.

3. The method of claim 2 including:

controlling the flowrate of said gaseous oxidant to said mixing zone to maintain the volume of said trapped gaseous oxidant substantially constant.

4. The method of claim 3 wherein said lixiviant comprises:

an aqueous carbonate solution; and said gaseous oxidant comprises:

oxygen.

5. An apparatus for mixing a gas and a liquid at a downhole location within a well, said apparatus comprising:

a conduit adapted to be connected at its upper end to a supply of said gas;

a mixing means adapted to be positioned near the lower end of said conduit when in an operable position within said well, said mixing means comprising:

means for trapping said gas after it exits from said conduit;

means for directing said liquid being flowed down said well through said trapped gas; and means below said mixing means for removing undissolved gas from said liquid.

6. The apparatus of claim 5 wherein said means for trapping said gas comprises:

packing means which prevents the flow of said gas upward therethrough when flooded but permits the downflow of liquid therethrough.

7. An apparatus for mixing a gas and a liquid at a downhole location in a well, said apparatus comprising:

a conduit adapted to be connected at its upper end to a supply of gas;

a mixing means adapted to be positioned near the lower end of said conduit when in an operable position, said mixing means comprising:

a housing adapted to be positioned around the lower end of said conduit;

said housing having an opening in its upper end of a substantially smaller diameter than the diameter of the well;

packing means in said opening which when flooded prevents upflow of gas therethrough but permits downflow of liquid therethrough; and an opening in said conduit below said packing means to allow flow of said gas from said conduit into said housing.

8. The apparatus of claim 7 including:

means for controlling the flowrate of said gas to said housing to maintain the volume of gas within said housing substantially constant.

9. The apparatus of claim 8 wherein said means for controlling the flowrate of gas comprises:

a valve positioned on said conduit and moveable between open and closed positions with respect to said opening in said conduit, and means on said valve responsive to the buoyant conditions of said liquid and said gas within said housing to move said valve between said open and closed positions.

10. The apparatus of claim 9 including:

packing means closing the lower end of said housing, said packing means when flooded preventing downflow of free gas but permitting downflow of liquid and dissolved therein.

11. The apparatus of claim 10 including:

means to attach said housing to said conduit.

12. The apparatus of claim 11 including:

means to seal said housing to the inner wall of said well when said mixing means is in an operable position within said well.

13. An apparatus for mixing a gas and a liquid at a downhole location within a well, said apparatus comprising:

a conduit adapted to be connected at its upper end to a supply of said gas;

a mixing means adapted to be positioned near the lower end of said conduit when in an operable position, said mixing means comprising:

means attached to said conduit which when flooded prevents the upward flow of gas, said means having restrictive passages therethrough for directing the flow liquid downward through said mixing means;

an opening in said conduit below said mixing means to allow flow of said gas from said conduit; and means below said mixing means for removing undissolved gas from said liquid after it has passed through said mixing means.

14. The apparatus of claim 13 including:

means for controlling the flowrate of the gas from said conduit to maintain the volume of gas below said mixing means substantially constant.

15. The apparatus of claim 14 wherein said means for controlling the flowrate of the gas comprises:

a valve positioned on said conduit and moveable between open and closed positions with respect to said opening in said conduit; and means on said valve responsive to the buoyant conditions of the liquid and gas below said mixing means to move said valve between said open and closed positions.

* * * * *